US006027010A

United States Patent [19]

Shira

[11] Patent Number: 6,027,010

[45] Date of Patent: Feb. 22, 2000

[54] METHOD OF BRAZING CERAMIC AND CERMET COMPONENTS FOR GOLF CLUBS AND THE ARTICLE PRODUCED THEREBY

[75] Inventor: Chester S. Shira, San Diego, Calif.

[73] Assignee: Carbite, Inc., San Diego, Calif.

[21] Appl. No.: 09/098,661

[22] Filed: Jun. 17, 1998

[51] Int. Cl.[7] ..... B23K 1/19; A63B 53/04

[52] U.S. Cl. ..... 228/124.5; 228/122.1; 473/349

[58] Field of Search ..... 228/122.1, 124.5; 473/349

[56] References Cited

U.S. PATENT DOCUMENTS 4,793,616 12/1988 Fernandez .
5,016,883 5/1991 Kobayashi .
5,154,425 10/1992 Niskanen et al. .
5,403,007 4/1995 Chen .
5,486,223 1/1996 Carden .
5,595,548 1/1997 Beck .
5,669,825 9/1997 Shira .

*Primary Examiner*—Patrick Ryan
*Assistant Examiner*—Jeffrey T. Knapp
*Attorney, Agent, or Firm*—John L. Gray, Esq.; Kegler, Brown Hill & Ritter, LPA

[57] ABSTRACT

A method of making a golf club head by brazing certain ceramic materials to certain metals utilizes certain brazing alloys so as to provide upon cooling a compressively loaded component of said golf club head.

3 Claims, 1 Drawing Sheet

METHOD OF BRAZING CERAMIC AND CERMET COMPONENTS FOR GOLF CLUBS AND THE ARTICLE PRODUCED THEREBY

BACKGROUND OF THE INVENTION

Ceramics and cermets have been attractive materials for golf clubs because of their hardness, wear resistance and light weight. However, the limited ductility and resistance to fracture of ceramics and cermets as well as limited joining methods for attachment to other components of golf club heads have severely limited their use.

Ceramic inserts have been attached to the face of golf clubs by the use of various non-metallic adhesives. Entire golf club heads have been fabricated from ceramics and cermets. However, these have not proved satisfactory because of early failures of the ceramic and cermet components. The dominant modes of failure have been cracking and spalling.

BRIEF SUMMARY OF THE INVENTION

Applicant has found that ceramics and cermets may be successfully joined to metals to produce composite golf club heads by the use of brazing alloys. If the metal being used is not a reactive metal such as titanium or zirconium, it is necessary to have a reactive material in the brazing alloy so the proper wetting of the created alloy on the ceramics and oxides will occur. Where the metal used is titanium or zirconium, the brazing alloy will absorb enough titanium or zirconium to create extremely free flowing and wetting behavior. By thus joining the ceramic or cermet components to metal portions of the golf club head, compressive stresses are created rather than tensile stresses which virtually eliminates failure of the ceramic and cermet from cracking and spalling. The compressive loading created by the base metal and braze alloy shrinkage upon cooling creates a condition most favorable for impact loading for a golf club face.

It is therefore an object of this invention to provide a method of joining ceramic or cermet components to metal golf club heads wherein the ceramic and cermet components are resistant to failure by cracking or other stress induced causes.

It is also an object of this invention to produce a golf club head comprising a compressively loaded ceramic component.

This, together with other objects of the invention, will become apparent from the following detailed description of the invention and the accompanying drawings.

DETAILED DESCRIPTION OF THE INVENTION

Figure 1:
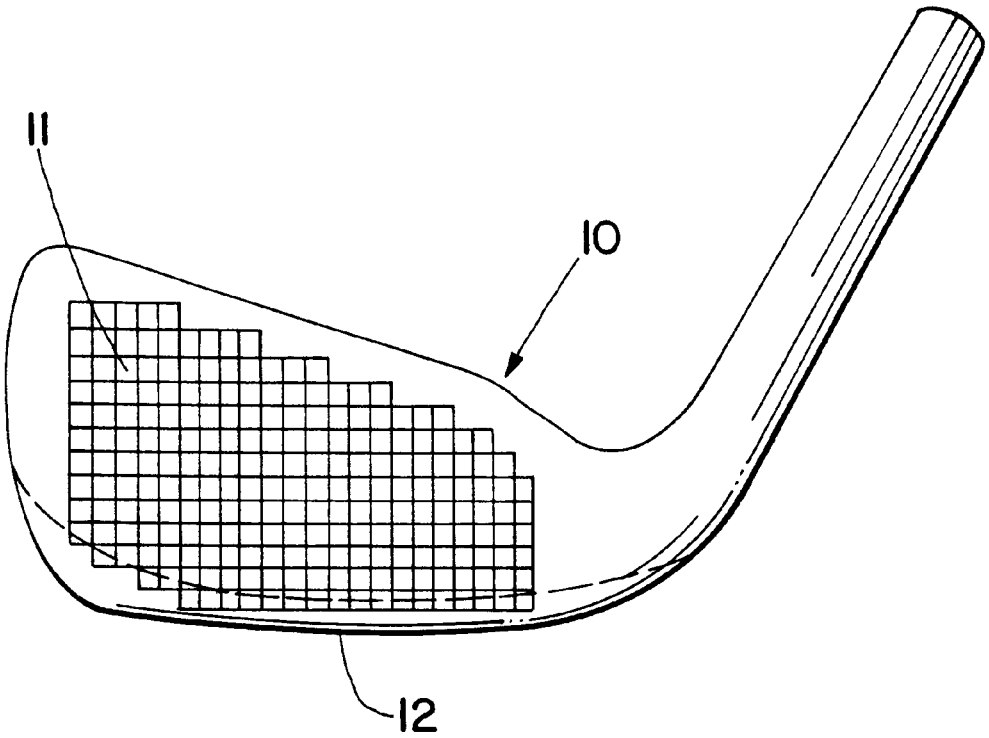
FIG. 1 shows a typical golf club face on a side elevation golf club head.
Figure 2:
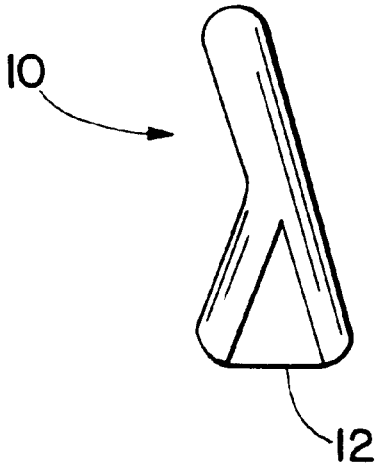
FIG. 2 shows an end view of a golf club head.

Referring now to the drawings, FIG. 1 shows a typical metal golf club head 10 provided with a ceramic facing 11 which may be made by the process of this invention. FIG. 2 is an end view of FIG. 1 showing the golf club head 10 with a ceramic insert 12 which may also be made by the method of this invention. Set forth are various examples of the use of applicant's invention:

EXAMPLE 1

An alumina tooling sheet 0.025" thick was used to support a titanium golf club head while a tungsten steel insert was being brazed with a silver copper alloy BAg Grade 8. The ceramic plate extended over 2"0 beyond the brazed joint. The brazed alloy successfully joined the titanium to the tungsten component and also made contact with the ceramic tooling piece and flowed, by capillary action, over 2" to the end of the alumina piece. The alloy completely filled the joint and created a perfect braze fillet on both sides of the tooling piece. In attempting to remove the ceramic tooling piece, the club head was placed in a vice and the ceramic was repeatedly struck with a hammer. Repeated moderate blows with a 2# hammer failed to damage the alumina. With a significantly heavier blow; some cracking and spalling occurred. It was impossible to remove the ceramic completely, but it was finally possible to fracture sections and get most of the ceramic out of the area, thus showing its tremendous resistance to impact.

The results obtained in the above example can be explained by the fact that the copper silver braze alloy absorbed enough titanium to create an alloy known to wet and flow on most ceramics and oxides. Thus a brazing alloy that normally would not wet and flow on titanium exhibited extremely free flowing and wetting behavior. Further, the brazing alloy has a greater coefficient of expansion than the ceramic and thus, on cooling creates a residual compressive stress in the ceramic. The residual compressive stress is high enough to avoid creation of significant tensile stresses when hammering the ceramic in an attempt to remove it. Without tensile stresses ceramics and cermets are most resistant to failure.

An example of this would be thermally sprayed ceramics which are presently used on golf club ball striking surfaces. Since these ceramics are very hot when applied and the base metal is cool, there are significant residual tensile stresses in the ceramic when it cools. Clubs with these surfaces suffer severe cracking, chipping, and spalling damages on all surfaces when striking hard objects such as a golf ball.

Ceramic inserts have been adhesively bonded to golf club striking surfaces and these also suffer damage when struck by hard objects. Damage occurs most commonly on top, bottom and side edges, but can also occur at any point, particularly if there are adhesive voids or unsupported areas. Again, the ceramic insert is not under compressive stress.

EXAMPLE 2

A 0.125" thick silicon nitride face insert was vacuum furnace brazed to a titanium 5 "iron" casting. The brazing alloy was an eutectic composition of 72% silver and 28% copper with a liquidus/solidus temperature of 1435° f. and a brazing temperature of 1550° f. The vacuum was approximately $10^{-4}$ Torr and time at temperature was 30 minutes. This particular brazing alloy will not wet and flow on most ceramics, but when the molten alloy is also in contact with titanium, several percent titanium is taken into solution with the brazing alloy and the ceramic is easily wetted and brazed to the titanium component. Upon cooling, the titanium's and brazing alloy's higher coefficient of contraction causes a metal shrinkage rate differential high enough to significantly load the ceramic component in compression. Subsequent testing of the brazed insert revealed that the ceramic was almost impossible to fracture even when exposed to direct hammer blows with a 2# ball peen hammer. The brazing alloy had wetted and covered the entire abutting surfaces with almost no voids in the joint. Similar blows on a ceramic insert bonded with a high impact adhesive immediately created fractures with very light blows, particularly on edges and corners of the ceramic insert. Clearly, the compressive loading created by base metal and braze alloy shrinkage created a condition most favorable for impact loading in a golf club face.

EXAMPLE 3

Aluminum oxide strips 0.025" thick by ½" wide were brazed to a titanium casting using identical materials and procedures as described above. The brazing alloy readily wetted abutting surfaces and flowed by capillary action between the abutting members for a distance of 3". The compressive stresses created in the aluminum oxide made it nearly impossible to remove the strips by repeated blows with a 2# ball peen hammer.

EXAMPLE 4

A silicon nitride insert was vacuum furnace brazed to a 17-4ph stainless steel golf club casting, using the same procedure described in example 3 except that the brazing alloy was a special grade of nominally 71% silver-27% copper containing approximately 2% titanium. The compressive stresses created in the silicon nitride insert made it nearly impossible to remove the insert by repeated blows with a 2# ball peen hammer.

In addition to the methods employed in the above examples, brazing compounds or brazing alloys could be plated on either or both components being joined and the parts could be heated and joining could take place by creating a suitable brazing alloy and subsequent joint in situ.

While this invention has been shown and described with respect to a detailed embodiment thereof, it will be understood by those skilled in the art that various changes in form and detail thereof may be made without departing from the scope of the claims of the invention.

What is claimed is:

1. A method of making a golf club head by brazing ceramic materials selected from the group consisting of alumina, silicon carbide, silicon nitride, zirconia and boron nitride to metals selected from the group consisting of titanium, stainless steel, maragining steel, low carbon steel and zirconium by using brazing alloys.

2. The method of claim 1 wherein the metals are selected from the group consisting of stainless steel, maragining steel and low carbon steel and the brazing alloys include a metal selected from the group consisting of copper, gold, palladium and platinum, wherein the brazing alloys further contain a reactive metal.

3. The method of claim 1 wherein the metals are selected from the group consisting of titanium and zirconium and the brazing alloys include a metal selected from the group consisting of copper, gold, palladium and platinum.

* * * * *